United States Patent [19]

Wendt

[11] 4,107,887

[45] Aug. 22, 1978

[54] SOUND ABSORBING SYSTEM

[75] Inventor: Alan C. Wendt, Barrington, Ill.

[73] Assignee: United States Gypsum Company, Chicago, Ill.

[21] Appl. No.: 650,634

[22] Filed: Jan. 20, 1976

[51] Int. Cl.[2] ..... E04B 1/00

[52] U.S. Cl. ..... 52/105; 52/235; 52/474; 52/509; 52/512; 52/585

[58] Field of Search ..... 52/488, 487, 509, 512, 52/378, 134, 235, 475, 656, 144, 145, 704, 378, 98, 506, 235, 474, 105, 585; 156/84–86; 181/33 GA

[56] References Cited

U.S. PATENT DOCUMENTS

| | | | |
|---|---|---|---|
| 777,334 | 12/1904 | Dieterich | 52/509 |
| 1,052,670 | 2/1913 | La Francis | 52/509 |
| 1,989,289 | 1/1935 | Piazza | 52/489 |
| 2,008,718 | 7/1935 | Jenkins | 181/33 GA |
| 2,101,181 | 12/1937 | Johnson | 52/475 |
| 2,802,764 | 8/1957 | Slayter et al. | 181/33 GA |
| 2,853,870 | 9/1958 | Sinner et al. | 52/509 |
| 3,251,164 | 5/1966 | Wright | 52/488 |
| 3,282,004 | 11/1966 | Brounn | 52/509 |
| 3,628,297 | 12/1971 | Richardson | 52/311 |
| 3,888,055 | 6/1975 | Gallo | 52/136 |

FOREIGN PATENT DOCUMENTS

| | | | |
|---|---|---|---|
| 588,339 | 12/1959 | Canada | 52/509 |
| 1,006,109 | 9/1965 | United Kingdom | 156/86 |

*Primary Examiner*—James L. Ridgill, Jr.
*Attorney, Agent, or Firm*—Glenn W. Ohlson; Samuel Kurlandsky; Robert H. Robinson

[57] ABSTRACT

A clip is disclosed for securing sound absorbing panels or the like to supporting structures. The clip has a wall plate, a projection extending outwardly from the wall plate and at least two securing members at the end of the projection opposite the wall plate, with the securing members each extending further in one direction from the projection than their extension from the projection in the opposing direction.

A sound absorbing system is disclosed and includes a supporting structure, clips, as defined above, attached to the supporting structure, and sound absorbing panels attached to the clips. The sound absorbing panels comprise a sound absorbing panel with a frame extending around the exterior perimeter of the panel, and the frame has a plurality of openings for accepting the securing members. The securing members are placed into the openings to attach the sound absorbing panels to the supporting structure.

10 Claims, 10 Drawing Figures

SOUND ABSORBING SYSTEM

BACKGROUND OF THE INVENTION

1. Field of the Invention

This invention relates to a clip for securing sound absorbing panels to a supporting structure and the resulting system made possible thereby.

2. Description of the Prior Art

In recent years, industry has become aware of the need for industrial noise pollution control, and this has generated a need for systems to provide such control. Previous systems have been merely sound absorbing material draped from the ceiling or panels of sound absorbing material rigidly attached to the walls in the area for the purpose of absorbing the sound. Prior to the present invention there has yet to be developed a system making use of removable panels to achieve access to the supporting structure behind the panels. Additionally, prior to this invention, there has not been developed a system which can be installed over a supporting structure that has utility pipes or the like on the surface thereof without some type of additional construction to support the sound absorbing panels. The new system provided herein fulfills the requirement of this long felt need.

Clips for retaining panels to supporting structures are not new. Norwegian Patent N.R. 73,842 illustrates a clip with prongs at the end for engaging a kerfed portion of a panel. Removability of this system is not good, however, and the attachment to the supporting structure is not sufficiently rigid to accept and support a panel, since the object of the clip is merely to center the panel and not to support its weight.

U.S. Pat. No. 3,282,004 illustrates panels with openings along the rim thereof, and clips which merely have one projection for engaging the openings. One clip in this structure, however, cannot accommodate two separate and distinct panels thereby limiting versatility and adaptability of the systems. On the other hand, U.S. Pat. No. 3,561,182 illustrates a clip that can accommodate two panels, but the panel must either be kerfed or designed to fit into a slot in the clip, and the clip can only be attached to the supporting structure through a channel arrangement. No showing is made of attaching the clip to a flat supporting structure. In British Patent No. 658,209, a building block system is shown with a block in an H-shape, but while the design resembles the clip of this invention, its use could not be extended to the present system since it has none of the design features for accommodating sound absorbing panels and was, in effect, meant only for use as spacers or building blocks.

In British Patent No. 506,438, concrete slabs were attached to walls by angle iron members deformed at one end to engage the concrete blocks. This system did not provide for ready removability of the panels, and the resulting system was anything but sound absorbing.

U.S. Patent No. 1,052,670 disclosed building veneer attachments with a clip having a wall plate, a projection, and legs extending from the end of the projection, but only one type of attachment was disclosed and there was no mobility within the system to accommodate changes in the supporting structure surface. Additionally, this system did not provide for removing of any of the panels without removing all of the panels in a series.

U.S. Pat. No. 2,142,305 disclosed clips for attaching building units, but these were rigid units and the clip merely attached the two together rather than providing for hanging of a sound absorbing system. Additionally, the disclosure was made only to horizontal systems and was not contemplated to be a system designed to cover a wall.

U.S. Pat. No. 2,209,375 illustrated clips used for attaching wall sheathing to a wall but only one type of attachment was disclosed, and the system could not accommodate irregularities in the wall surface. On the other hand, U.S. Pat. No. 2,279,515 illustrated furnace wall construction wherein panels were attached together by clips, but the clipping required concealment of the clip in a kerfing in order not to expose the clip to the conditions in the furnace.

U.S. Pat. No. 2,853,870 illustrated a clip for installing removable wall facing panels, but the clip merely illustrated two equal size arms on the end of a projection which would accommodate the kerfing in a facing panel and required kerfing of the facing panel. U.S. Pat. No. 3,319,983 disclosed a similiar system, but the attachment to the wall supporting structure required a channel member within the scope of that disclosure. Likewise, U.S. Pat. No. 3,466,825 showed a clip with projections from the end thereof, but the system was rigid, not removable, and required the clip to be firmly driven into the wall panel.

Other patents disclosing clips for attaching wall panels include U.S. Pat. No. 3,478,480 which disclosed a clip comprising a wall plate with a projection from one end thereof, and a button shaped projection on the outside of the clip to engage kerfing in the wall panel. This system did not provide for any type of sound absorption and could engage the panels only when on the top or bottom thereof, with wedging or some other feature being necessary to use the clip if it was to be attached to the sides of the panels. Additionally, it could not accommodate irregularities in the supporting structure unless a frame were built around the irregularity. Perhaps the closest design in the clip of the present invention is disclosed in U.S. Pat. No. 2,435,172 wherein a clip has a wall plate, a projection, and legs at the end of the projection, but, again, this system is for wall furnaces, and the system lacked sound absorption properties, and one panel was not removable without removing the entirety of a row of panels.

In all of the prior systems, the panels making use of attachment by the disclosed clips have either not been removable without removing an entire series of panels, or else the clip could not be used to attach a multiplicity of panels. In those few designs which could have indicated the possibilty of arriving at this type of system, there was no provision made for sound absorption or for accommodating irregularities in the supporting structure.

The new and novel clip of this invention, and the sound absorbing system made possible thereby, has overcome all of the difficulties associated with trying to use prior types of clips in attaching sound absorbing panels to supporting structures.

SUMMARY OF THE INVENTION

It is an object of this invention to provide a clip for attaching sound absorbing panels to supporting structures.

It is the further object of this invention to provide a clip for attaching sound absorbing panels to supporting structures with complete removability of the sound absorbing panels.

It is an additional object of this invention to provide a clip for attaching sound absorbing panels to supporting structures with the clip enabling the sound absorbing panels to be attached over projections extending away from the supporting structure without the need for construction of an additional supporting structure.

It is a still further object of this invention to provide a sound absorbing system which has removable sound absorbing panels and which will accommodate projections projecting away from the supporting structure.

The objects of this invention are accomplished by a clip comprising a wall plate, a projection extending outwardly from the wall plate, and at least two securing members at the end of the projection opposite the wall plate, with the securing members being attached between their ends and with the securing members each extending further in one direction from their attachment to the projection than they extend in the opposing direction from their attachment to the projection. It is preferred that the projection be perpendicular to the wall plate and the securing members perpendicular to the projection. While the securing members may be flat plates, they may also may have any other type of design which can accommodate an opening in a sound absorption panel and would include round rods attached between their ends to the end of the projection. It is further preferred that the longer end of the securing members be indented at a distance equal to the extension on the other side of the projection in order to allow for spacing or indexing of the sound absorbing panels. Additionally, this allows the panels to rotate about the indentation for purposes of removability.

While it is only necessary that the sound absorbing panel have a sound absorbing material supported by a frame of the type and description hereinbefore discussed, it has been found that one particularly acceptable type of sound absorbing panel is a sound absorbing panel having a sound absorbing material completely enclosed in a heat shrunk plastic material with the enclosed sound absorbing material then supported by the frame. In each instance, the sound absorbing material may be of any type necessary to accomplish the required sound absorption results, but it has been found to be particularly acceptable to use mineral fiber or glass fiber, having a density of from four to six pounds per cubic foot. In the preferred embodiment, the sound absorbing material may be coated with any conventional heat shrinkable plastic film, examples of which are polyvinyl chloride films, polypropylene films, polyethylene films, and the like. If desired, for additional support and protection, the enclosed sound absorbing material may, as desired, have on one or both faces, a perforated facing material such as a perforated metal and may also, if desired, have on the face opposing the source of the absorbed sound, a solid facing material for additional support.

The sound absorbing system made possible by this invention includes a supporting structure and the clips, as hereinbefore described, attached to the supporting structure by any conventional means such as nail, screws, or the like. The system also includes sound absorbing panels comprising a sound absorbing panel having a frame extending around the exterior perimeter of the panel, and with the frame having a plurality of openings for accepting the securing members on the clips. It is preferred that the openings be in rows with one row of openings along the front of the frame and the second set of openings being disposed near the rear of the frame. This enables the panels to be attached close to the wall in the case of attachment to the front set of openings and enables the panels to be set apart from the wall when the attachment is through the rear row of openings. It is preferred that the openings be adjacent to the corners of the frame in order to enable two adjacent sound absorbing panels to be engaged by a single clip. The sound absorbing material used in the sound absorbing panels may be any conventional type of sound absorbing material such as felt, mineral fiber, or the like. The frame should be rigid enough to support the sound absorbing material and to engage the clip without deformation or destruction.

It is preferred to have at least two openings near the edge of the panel in order that the clip can engage the panel without the clip projecting beyond the edge of the panel.

Still other objects will readily present themselves to one skilled in the art upon reference to the following specification, the drawings, and the claims.

BRIEF DESCRIPTION OF THE DRAWINGS

This invention may be more fully described, but is not limited by the attached drawings wherein.

DESCRIPTION OF THE PREFERRED EMBODIMENTS

Figure 1:
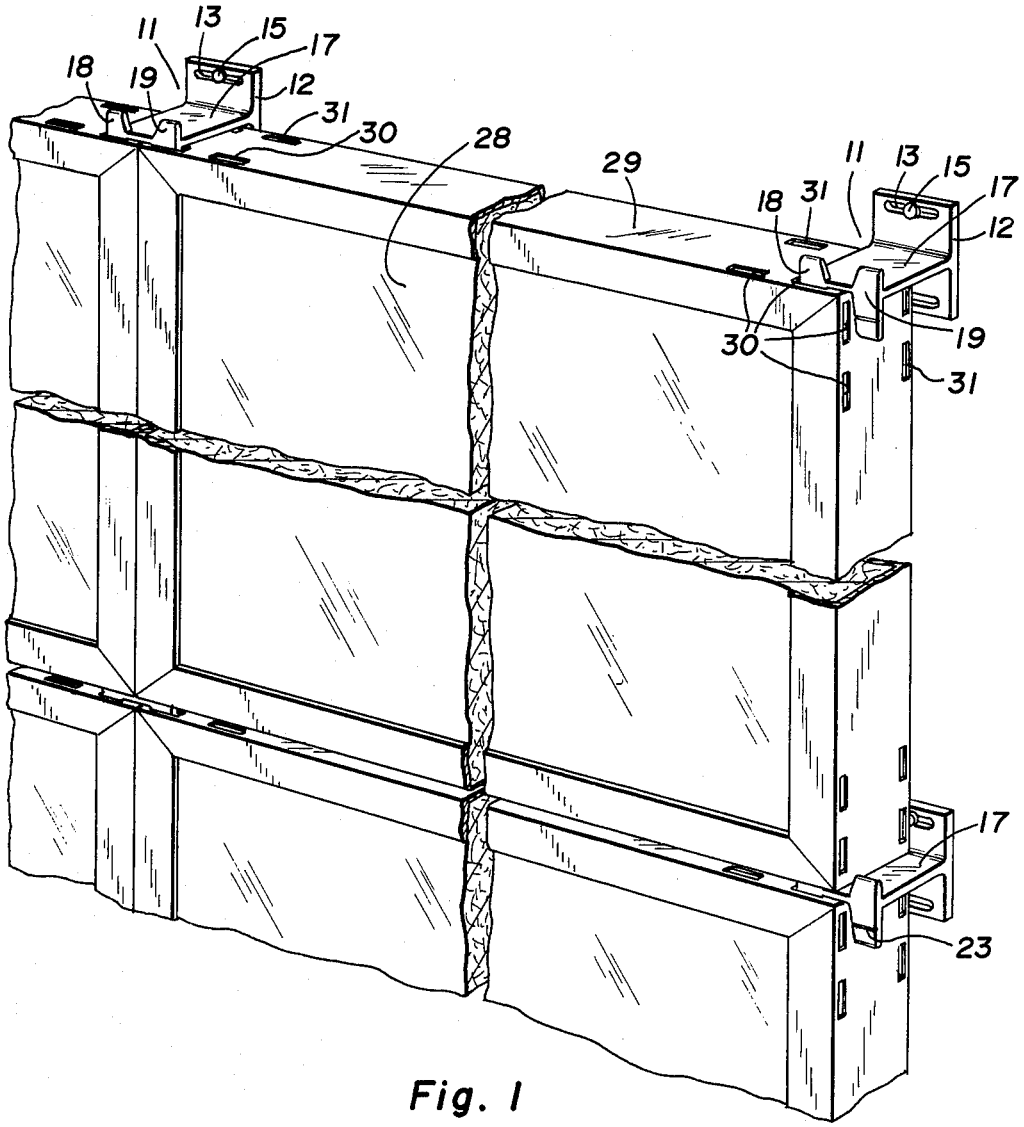
FIG. 1 is a perspective view of the sound absorption system of this invention.
Figure 2:
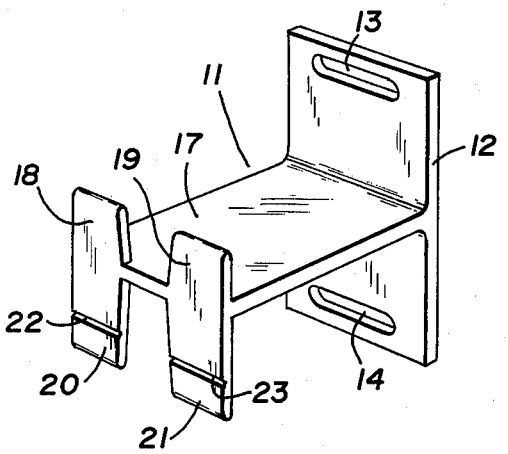
FIG. 2 is a perspective view of one embodiment of the clip of this invention.
Figure 3:
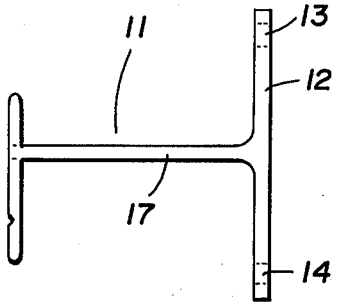
FIG. 3 is a side view of the clip of this invention illustrated in FIG. 2.
Figure 7:
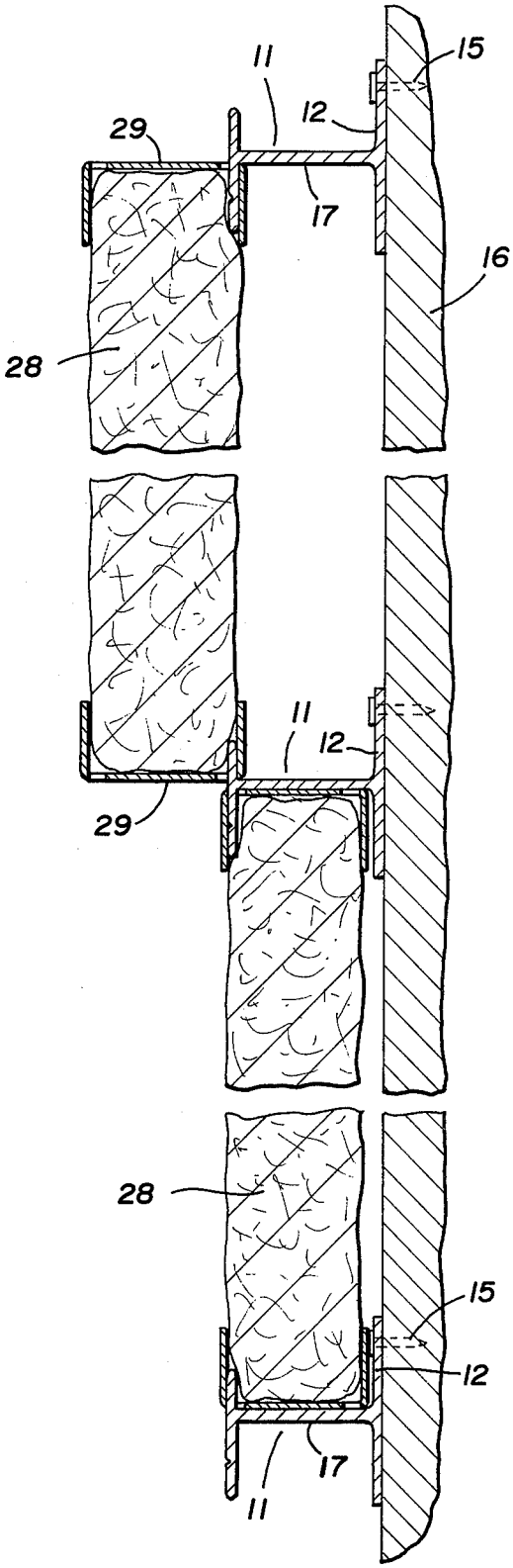
FIG. 7 is a cross-sectional side view of the attachment of sound absorption panels utilizing the clip of this invention.

This invention may be more fully described, but is not limited by reference to the preferred embodiments illustrated in the attached drawings wherein referring to FIG. 2 a clip 11 is illustrated with a wall plate 12 provided with slots 13 and 14 for accommodating an attachment device, such as nail 15 shown in FIG. 1 and FIG. 7, which is used for attaching the clip to a supporting structure, such as wall 16. The clip has a projection 17 projecting outward from the wall plate and generally perpendicular thereto. At the end of the projection are securing members 18 and 19 projecting generally perpendicular to the projection member and attached between the ends of the securing members. On end, in this illustration the lower end 20 and 21 of the securing members is longer than the opposing ends and the longer ends are preferably indented by depressed indentations 22 and 23 spanning the width of the longer ends which allow the sound absorbing panels to be indexed or spaced apart a distance sufficient to allow for removability. The clip should be attached such that the panel frames do not extend beyond the indentations in order that the panels can be easily removed.

Figure 4:
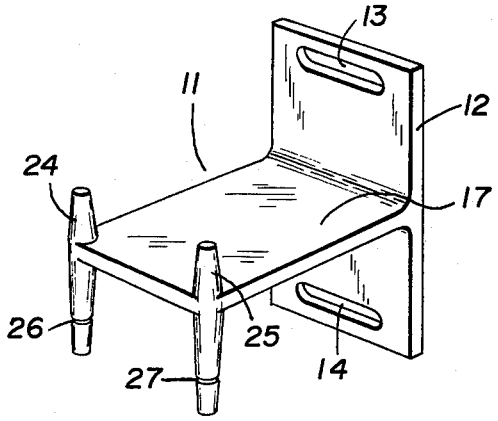
FIG. 4 is a perspective view of a second embodiment of the clip of this invention.

Referring to FIG. 4, the securing members 24 and 25 are shown to be round rods, again with indentations 26 and 27 to enable indexing of the sound absorbing panels about the indentation, but the securing members may be any design which will accommodate the corresponding opening in the sound absorption panel.

Figure 5:
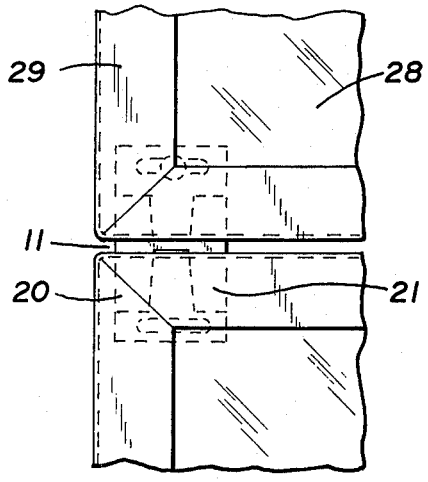
FIG. 5 is a front view of the attachment of the sound absorption panels of this invention illustrating the use of the clip of this invention.
Figure 6:
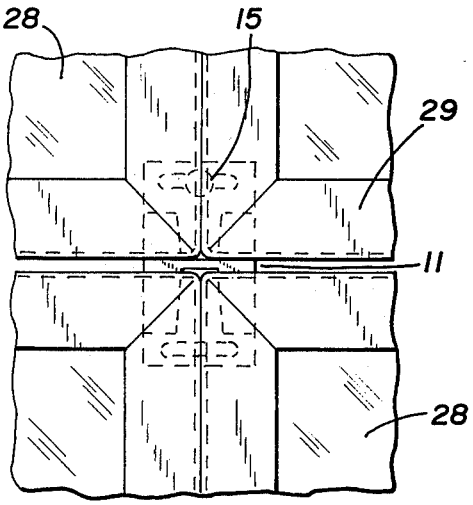
FIG. 6 is a front view of the corners of four sound absorption panels being attached by the clip of this invention.
Figure 9:
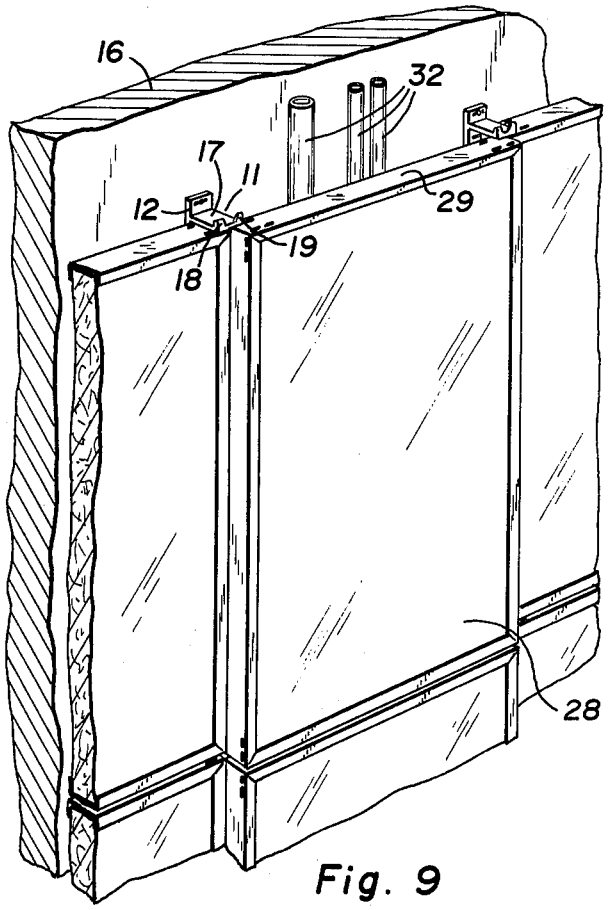
FIG. 9 is a perspective view of the sound absorption system of this invention shown accommodating vertical utility pipes adjacent to the wall supporting structure.
Figure 10:
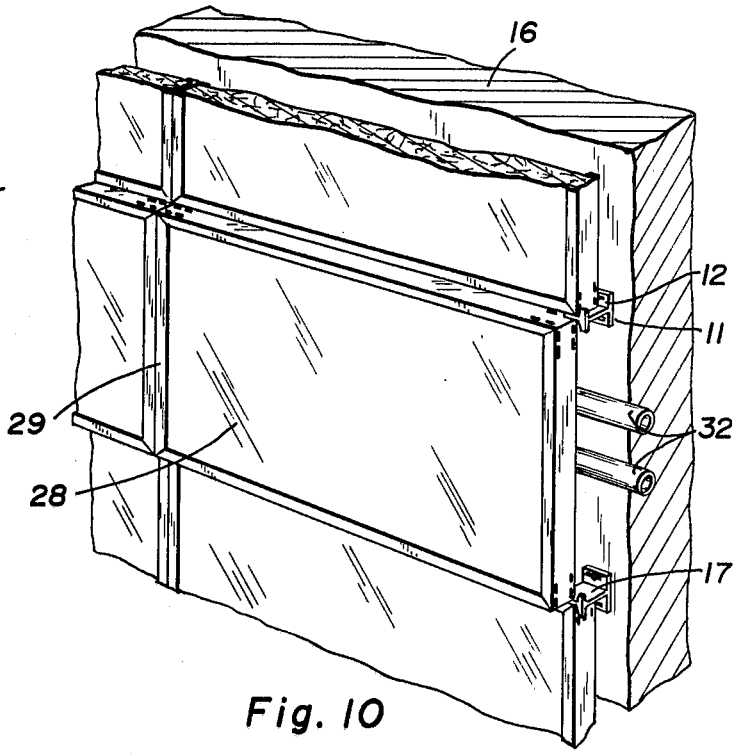
FIG. 10 is a perspective view of the sound absorption system of this invention showing the accommodation of horizontal utility pipes next to the supporting structure.

Referring now to FIG. 1, a sound absorption panel is comprised of a sound absorption material 28 having a frame 29 extending around the perimeter thereof. A front row of openings 30 is located near the front side of the panel and, preferably, extends to the corners of the frame in order to attach two or more panels by one clip as is shown in FIG. 5 and FIG. 6. A rear row of openings 31 is shown located near the rear of the panel and enables attachment of the panels in the same manner as the front row of openings but provides that attachment to the rear set of openings will create an offset or spacing outward of the panels as is shown in FIG. 9 and FIG. 10 in order to accommodate utility pipes 32 adjacent to the supporting structure. An additional feature of this type of design is that offset or spaced outward sound absorbing panels increases the absorption of high frequency sound contacting the panels and thereby provides more efficient sound control.

Figure 8:
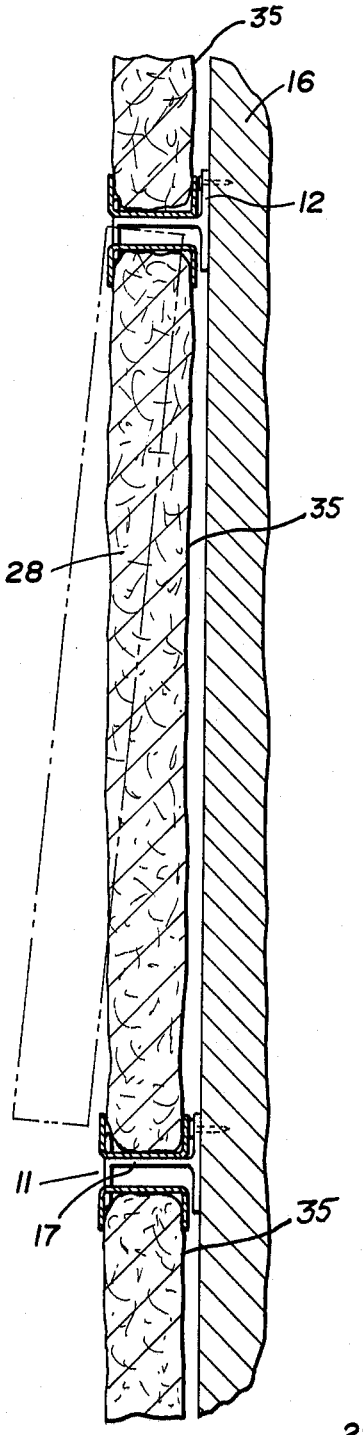
FIG. 8 is a cross-sectional side view of sound absorption the removability of the panels.

In FIG. 8, the removability of the sound absorption panels is disclosed and can be accomplished merely by lifting the panel upward on the upper set of clips and rotating the panel outward about the indentation followed by merely slipping the panel off of the clip. Also, the sound absorbing material is shown enclosed in a heat shrunk plastic film 35.

While only several forms and embodiments of the invention have been shown and described, other forms and embodiments within the spirit and scope of the invention will become apparent to those skilled in the art. Therefore, the forms and embodiments shown in the drawings are to be considered as merely setting forth the invention for illustrative purposes and are not intended to limit the scope of the invention herein described and shown.

It may thus be seen that the new and novel clip and sound absorption panel system made possible thereby are a significant advance to anything known previously in the industry. This system provides for sound absorption panels which can easily be attached to a supporting structure and which have complete removability. In addition, the system accommodates utility pipes or the like which are adjacent to the supporting structure.

Having fully described this new and unique invention, the following is claimed:

I claim:

1. A sound absorbing structure comprising the combination of a supporting structure, clips attached to the supporting structure, and sound absorbing panels attached to the clips, wherein said sound absorbing panels comprise a sound absorbing material with a frame extending around the exterior perimeter of the material, said frame having a plurality of openings for accepting a securing member, and wherein said clips each comprise a wall plate, a projection extending outwardly from the wall plate, and at least two securing members integrally attached between their ends to the end of the projection opposite the wall plate, said securing members each extending further in one direction from the projection than their extension from the projection in the opposing direction, with a surface of the longer side having a depressed indentation therein spanning the width of the longer side, and located thereon at a distance from its attachment at the end of the projection equal to the extension on the other side of the projection; and said wall plates clips being attached to said supporting structure and said openings of the frames of the sound absorbing panels engaging the securing members to affix the sound absorbing panels to the supporting structure.

2. A structure as in claim 1 wherein the openings on the frame of the sound absorbing panel are disposed near the corners of the frame to enable adjoining panels to be engaged by a single clip.

3. A structure as in claim 1 wherein the openings are sufficiently interior to the edge of the frame member to prevent the clip from extending beyond the edge of the panels.

4. A structure as in claim 1 wherein the openings in the frame are in at least two rows with one row of openings near the front of the panel and the other row of openings near the rear of the panel.

5. A structure as in claim 4 wherein at least one of the panels is offset from the other panels by some of the panels being attached by securing members engaging the front row of openings and other of the panels being attached by securing members engaging the rear row of openings.

6. A structure as in claim 1 wherein the sound absorbing panels comprise a sound absorbing material completely enclosed in a heat shrunk plastic material.

7. A structure as in claim 6 wherein the sound absorbing panels have a perforated facing material on at least one face.

8. A structure as in claim 6 wherein the projection on the clip is perpendicular to the wall plate and the securing members on the clip are perpendicular to the projection.

9. A structure as in claim 8 wherein the securing members on the clip are flat plates.

10. A structure as in claim 8 wherein the securing members on the clip are round rods.

* * * * *

UNITED STATES PATENT OFFICE

CERTIFICATE OF CORRECTION

Patent No. 4,107,887 Dated August 22, 1978

Inventor(s) Alan C. Wendt

It is certified that error appears in the above-identified patent and that said Letters Patent are hereby corrected as shown below:

Col. 3, line 23, delete "may" (second occurrence).

Signed and Sealed this

*Twenty-sixth* Day of *February 1980*

[SEAL]

*Attest:*

SIDNEY A. DIAMOND

*Attesting Officer*

*Commissioner of Patents and Trademarks*